US006484428B1

(12) United States Patent
Greenwald et al.

(10) Patent No.: US 6,484,428 B1
(45) Date of Patent: Nov. 26, 2002

(54) DOUBLE-SIDED MAGNET WITH GRAPHICAL IMAGE ON EACH SIDE

(75) Inventors: Evelyn Greenwald, Cleveland Heights, OH (US); Patrick Baran, Cleveland, OH (US); Paul Tamulewicz, Cleveland, OH (US)

(73) Assignee: A.W. Faber-Castel U.S.A., Cleveland, OH (US)

( * ) Notice: Subject to any disclaimer, the term of this patent is extended or adjusted under 35 U.S.C. 154(b) by 0 days.

(21) Appl. No.: 09/502,742

(22) Filed: Feb. 11, 2000

(51) Int. Cl.[7] ..... G09F 7/04

(52) U.S. Cl. ..... 40/600; 40/124.04; 40/621

(58) Field of Search ..... 40/600, 124.04, 40/621, 711, 594; 335/296, 297, 302, 303; 446/129, 137, 901; 434/73, 190, 305, 347, 367, 369, 395, 396, 430, 168; 273/239

(56) References Cited

U.S. PATENT DOCUMENTS

| | | | | | |
|---|---|---|---|---|---|
| 3,093,919 | A | * | 6/1963 | Holtz | 40/621 |
| 3,496,653 | A | * | 2/1970 | Wolfner et al. | 434/168 |
| 3,755,938 | A | * | 9/1973 | Bytwork | 434/430 |
| 4,584,223 | A | * | 4/1986 | Krapf | 428/58 |
| 4,846,689 | A | * | 7/1989 | Day | 434/190 |
| 5,112,052 | A | | 5/1992 | Yamaura | 273/153 R |
| 5,178,573 | A | * | 1/1993 | Smith | 446/73 |
| 5,362,271 | A | * | 11/1994 | Butt | 446/129 |
| 5,666,712 | A | * | 9/1997 | Cvetkov | 40/711 |
| 5,820,383 | A | * | 10/1998 | Levins | 434/190 |
| 5,994,990 | A | * | 11/1999 | Ogikubo | 40/600 |

OTHER PUBLICATIONS

Gladden, U.S. Statutory Invention Registration No. H46; published Apr. 1, 1986.*

Kling Magnetics, Inc., Magic Wall product information, http://www.kling.com/magicwall.html, Accessed Sep. 29, 1999.

Kling Magnetics, Inc., Magic Wall Angel Babies product information, http://www.kling.com/babies.html, accessed Sep. 29, 1999.

Kling Magnetics, Inc., Magic Wall Checkers product information, http://www.kling.com/checkers.html, accessed Sep. 29, 1999.

Kling Magnetics, Inc., Magic Wall Chess product information, http://www.kling.com/chess.html, accessed Sep. 29, 1999.

Kling Magnetics, Inc., Magic Wall Calendar Set product information, http://www.kling.com/calendar.html, accessed Sep. 29, 1999.

Kling Magnetics, Inc., Magic Wall Hex Puzzle product information, http://www.kling.com/hexpuzzle.html, accessed Sep. 29, 1999.

Kling Magnetics, Inc., Magic Wall Accessories product information, http://www.kling.com/accessories.html, accessed Sep. 29, 1999.

Kling Magnetics, Inc., Magic Wall Magnetic Foam Letters product information, http://www.kling.com/letters.html, accessed Sep. 29, 1999.

* cited by examiner

*Primary Examiner*—Chuck Y. Mah
*Assistant Examiner*—Doug Hutton
(74) *Attorney, Agent, or Firm*—Calfee, Halter & Griswold LLP

(57) ABSTRACT

The present invention is a magnetic piece having outwardly facing first and second sides, each side with a different image disposed thereon. In a first embodiment, the magnetic piece has an image on first and second sides, wherein each image comprises a different expression of an object, with the object having at least one differing characteristic in each image. In a second embodiment of the present invention, a thick magnetic piece has a thickening layer between two magnetic layers. The magnetic piece is comprised of a single layer of magnetic material sandwiched between two layers of a printing medium. Alternatively, the magnetic piece is comprised of a thickening layer sandwiched between two magnetic layers, with a layer of printing medium annexed to the exterior surface of each magnetic layer. Each magnetic layer may be comprised of magnetic striping bands.

40 Claims, 8 Drawing Sheets

DOUBLE-SIDED MAGNET WITH GRAPHICAL IMAGE ON EACH SIDE

COPYRIGHT NOTICE

All of the individual images and collections of images in this Appendix are Copyright, Creativity for Kids. Thus, this Appendix contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

IMAGE DESCRIPTION

The sheets that follow are double-sided color copies of actual double-sided magnetic pieces and story boards embodying the present invention. The magnetic pieces are copied in two forms, (i) with the sandwiched sheet of material from which they were cut and (ii) removed from that sheet. Although the two sides of each double-sided copy are not precisely aligned, it is believed that one of ordinary skill in the art can understand which two images in this Appendix appear on each side of each double-sided piece, based on image size, image location, image content, image orientation, etc.

COPYRIGHT NOTICE

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

FIELD OF THE INVENTION

The present invention relates generally to a double-sided magnetic piece having images on both sides. Additionally, the present invention relates generally to a story board and a story tin, which are magnetically attracted to magnetic pieces and which include images of a story to which the images on each side of the magnetic piece also relate.

BACKGROUND OF THE INVENTION

The potential for magnets with images thereon has not been fully realized by those skilled in the art. It is known within the art to produce magnets of varying shapes and sizes comprised of a magnetic layer on one side and a layer of printed material on the other side, wherein the magnetic layer magnetically sticks to a ferromagnetic object, such as the front of a refrigerator or a slab of iron, and the layer of printed material is visible on the other side of the magnet. It is also known in the art to produce magnets with printed material on both sides of a magnetic layer.

It is also known within the art to produce thick magnets comprised of a magnetic layer, a thickening layer of foam and a layer of printed material, wherein the thickening layer is sandwiched in between the magnetic layer and the layer of printed material, so that the magnetic layer may stick to a ferromagnetic object while the layer of printed material is outwardly displayed.

SUMMARY OF THE INVENTION

The present Invention provides a magnetic piece comprising first and second magnetic sides, each side facing outwardly and having a different image disposed thereon. Each image comprises a different expression of an object, wherein the expressions are comprised of at least one characteristic which differs from one side to the other. In embodiments of the present invention, objects are characters, animals, buildings and other inanimate objects. Characteristics include facial expressions, body position, clothing, lighting, temporal indicia, seasonal indicia, etc.

In a first embodiment, the magnetic piece has an image on first and second sides, wherein each image comprises a different expression of an object, with the object having at least one differing characteristic in each image. In a second embodiment of the present Invention, a thick magnetic piece has a thickening layer between two magnetic layers.

In an embodiment of the present Invention, a magnetic piece is comprised of a single layer of magnetic material sandwiched between two layers of a printing medium with images annexed thereon.

In an alternate embodiment of the present Invention, a magnetic piece is comprised of a thickening layer sandwiched between two magnetic layers. The magnetic piece further has a layer of printing medium with images annexed thereto disposed on the exterior sides of each magnetic layer.

In a further embodiment of the present Invention, the magnetic layers comprise magnetic striping bands. The magnetic striping bands are preferably of uniform width, parallel to each other, and of alternating magnetic domain direction.

Advantages and benefits of the invention will become apparent to those skilled in the art upon reading and understanding the following detailed description.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below serve to example the principles of this Invention.

DETAILED DESCRIPTION OF THE PREFERRED EMBODIMENT

Figure 1A:
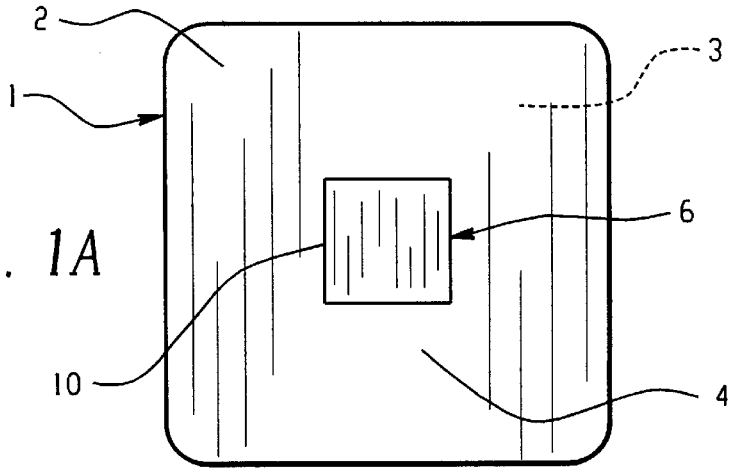
FIG. 1A is a top planar view of a first magnetic side of a magnetic piece of the present Invention.
Figure 1B:
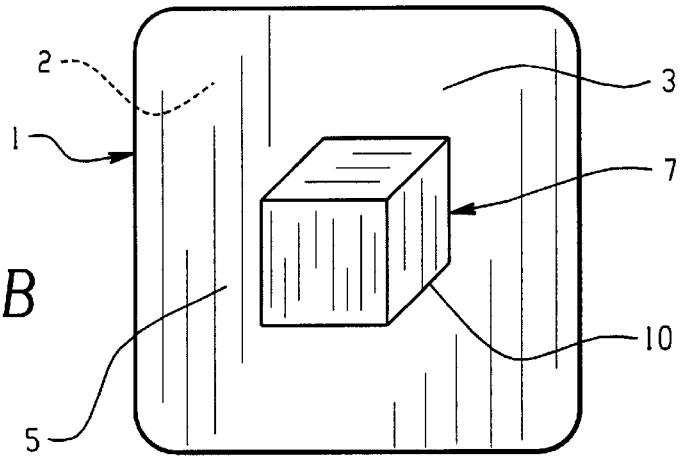
FIG. 1B is a top planar view of a second magnetic side of the magnetic piece of the present Invention.
Figure 2:
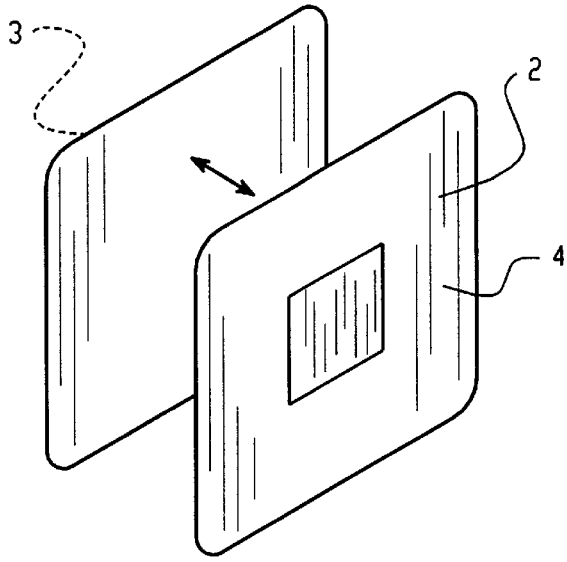
FIG. 2 is an angled, three-dimensional representation of a physical relationship between the first and second magnetic sides of a magnetic piece of the present Invention.

The present invention is directed to a magnetic piece. Referring now to the drawings wherein the showings are for the purposes of illustrating preferred embodiments of the invention only and not for purposes of limiting same, FIGS. 1A, 1B and 2 present an embodiment of a magnetic piece 1 of the present Invention comprised of a first magnetic side 2 and a second magnetic side 3. Each of said sides comprise a magnetic material. First magnetic side 2 has a first image 4 disposed thereon and second magnetic side 3 has a second image 5 disposed thereon. First image 4 comprises expression 6 of object 10, and second image 5 comprises expression 7 of object 10. Expression 6 of the first image 4 comprises a characteristic of object 10 that is different than expression 7 of the second image 5. More specifically to FIG. 1A, object 10 is a cube and the characteristic is the orientation at which the cube is being viewed. First image 4 has an expression 6 of the cube which comprises a side view of the cube in which only one side is visible. In FIG. 1B, second image 5 has an expression 7 of the cube which comprises a perspective view of the cube in which multiple sides of the cube are visible.

Referring to FIG. 2, first magnetic side 2 and second magnetic side 3 are situated so that first image 4 and second image 5 are facing outwardly. Preferably, first magnetic side 2 and second magnetic side 3 are disposed oppositely from each other and are positioned generally parallel to each other. While first magnetic side 2 and second magnetic side 3 are illustrated in FIG. 2 disposed oppositely from and positioned generally parallel to each other, and are preferably disposed as such, first magnetic side 2 and second magnetic side 3 need not be directly opposite each other or positioned generally parallel to each other.

Object 10 preferably comprises at least one character, animal, or inanimate object. Characters include, but are not limited to, fictional people, fictional characters, actual people, generic people, historical people, historical characters, animal characters or any depiction of a human being. Animals include, but are not limited to, a dog, cat, mouse, horse, snake, pig, sheep, raccoon, chicken, duck, deer, possum, owl, wolf, geese, and bear. An animal is distinguishable from an animal character in that an animal relates to an animal in general, such as a wolf or a pig, while an animal character relates to a specific animal with given characteristics, such as the Big Bad Wolf and The Three Little Pigs of the story of the same name. Inanimate objects include, but are not limited to, a house or other dwelling, food, chair, pot, a garden, cooking utensils, furniture, hay bails, a fire and a water bucket.

Each expression of each image of object 10 comprises at least one characteristic. Characteristics of images of character objects include, but are not limited to, any combination or permutation of any of the following: facial expression, clothing, hair color, skin color, eye color, body position, expressions of mood, expressions of action, clothing accessories, character activity and accessories. Characteristics of images of animal objects include, but are not limited to, any combination or permutation of any of the following: color, type of skin or fur, clothing, facial expression, body position, expressions of action or activity, and accessories. Characteristics of images of inanimate objects include, but are not limited to, any combination or permutation of any of the following: condition (e.g., new old, dilapidated, damaged, destroyed, under construction, under repair, under maintenance, etc.), orientation, viewing position (e.g., exterior or interior), color, size, position, components, expressions of action or activity, and accessories. Characteristics of any image may also include, but are not limited to, any combination or permutation of any of the following: lighting, temporal changes, day/night differentiation and seasonal changes.

In an embodiment of the present Invention, the first and second images 4, 5 comprise expressions of one of the Three Little Pigs from the story of the Three Little Pigs and the Big Bad Wolf. Each expression of the Little Pig comprises a facial expression characteristic. The first image on the first side comprises an expression of the Little Pig while the Big Bad Wolf is initially victorious in blowing the Little Pig's house down; the characteristic of the Little Pig's facial expression shows fear, anger, and general unhappiness. The second image on the second side comprises an expression of the Little Pig after the Three Little Pigs have ultimately triumphed over the Big Bad Wolf in a brick house; the characteristic of the Little Pig's facial expression shows happiness, contentment, and some smugness.

Images 4, 5 are disposed upon a magnetic side of a magnetic piece of the present Invention by any suitable means known to one skilled in the art. In an embodiment of the present Invention, a magnetic piece is comprised of a single layer of magnetic material having a first and second magnetic side, each of said magnetic sides having an image disposed thereon. Preferably, images are disposed upon a suitable printing medium layer which is annexed to a magnetic side of a magnetic piece, preferably by an adhesive. More preferably, images disposed upon a suitable printing medium layer are covered with a clear laminate or sealant. In an alternate embodiment of the present Invention, a magnetic piece is comprised of a single layer of magnetic material having a first and a second magnetic side, each of said sides having an image disposed thereon by means of a printing medium layer annexed thereto.

In a preferred embodiment of the present Invention, the magnetic sides of the magnetic piece are of substantially equal size and shape to each other, and the shapes of each magnetic side are aligned with each other so that no portion of any layer sticks out.

Figure 3A:
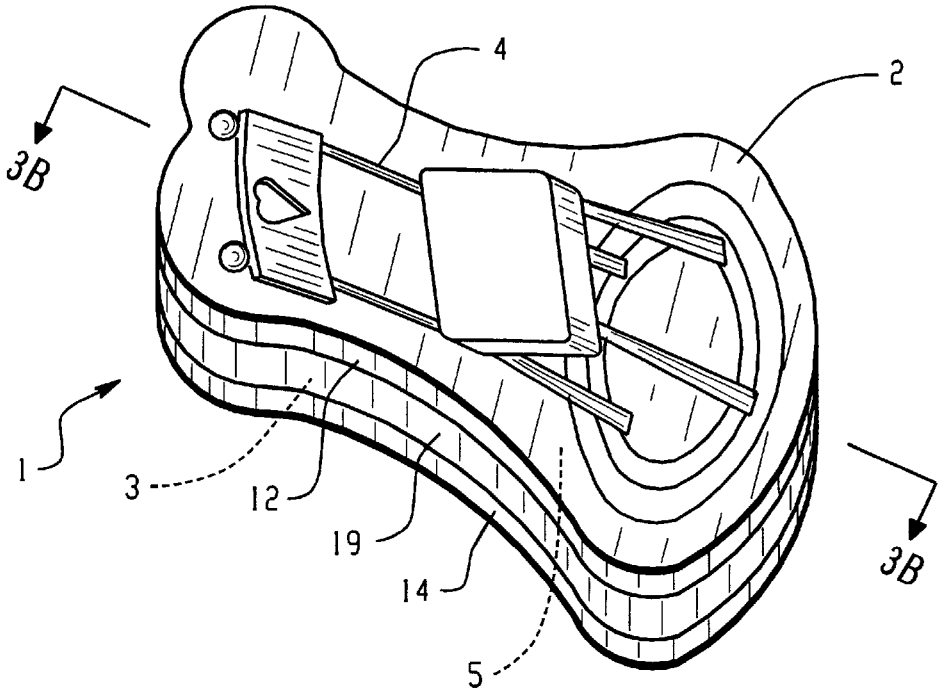
FIG. 3A is an angled, side view of a preferred embodiment of the present Invention.

Referring to FIG. 3A, in an embodiment of the present Invention, a magnetic piece 1 of this Invention comprises a first magnetic layer 12 and a second magnetic layer 14, and a thickening layer 19, sandwiched therebetween and physically annexed thereto. First magnetic layer 12 has image 4 physically annexed thereto and second magnetic layer 14 has image 5 (not shown) physically annexed thereto. First magnetic layer 12 and second magnetic layer 14 are situated so that the images 4, 5 annexed thereto are facing outwardly. Images 4, 5 may be directly applied to magnetic layers 12, 14. Preferably, referring to FIG. 3B, images 4, 5 are applied to first and second layers of print medium 20, 22, respectively, which are physically annexed to magnetic layers 12, 14 respectively. More preferably, printing medium layers 20, 22 have a covering layer, e.g., a layer of clear laminate or sealant applied thereto. Magnetic layers 12, 14 have a thickness 23, printing medium layers 20, 22 have a thickness 24, and thickening layer 19 has a thickness 21. Preferably, thickening layer 19 is thick enough toease pickup of a magnetic piece 1 by a human hand, which is especially important for use by children. More preferably, the thickness 21 of thickening layer 19 is between about 0.0312 inch and about 0.5 inches, the thickness 23 of magnetic layers 12, 14 is between about 0.028 inch and about 0.125 inch, and the thickness 24 of printing medium layers 20, 22 is between about 0.001 inch and 0.0156 inch. Still more preferably, the thickness 21 of thickening layer 19 is about 0.076 inch, the thickness 23 of magnetic layers 12, 14 is about 0.0312 inch, and the thickness 24 of coated printing medium layers 20, 22 is about 0.005 inch. In the latter embodiment, the thicknesses of the thickening layer and the magnetic layers are of a sufficient dimension to create a "friendly feel" of the magnets in the hands of a child. While the thicknesses 23 and 24 have been described as being the same for first and second magnetic layers 12, 14 and first and second printing medium layers 20, 22, thicknesses 23 and 24 may vary between the two, wherein the thickness of the first magnetic layer 12 is either greater or lesser than the thickness of the second magnetic layer 14, as is the case for first and second printing medium layers 20, 22.

The thickening layer 19 is comprised of any suitable material, with suitability depending on the particular environment in which the magnetic piece is to be used. Preferably, the thickening layer 19 does not materially effect the magnetic force attraction which is created by each magnetic layer 12, 14. Cardboard may suffice for certain environments as a thickening layer. More preferably, said thickening layer 19 is comprised of a material which is compressible, yet retains its initial shape when the compression force is removed. Still more preferably, said thickening layer 19 is comprised of foam. While embodiments of the present invention have been described as having a single thickening layer 19 physically attached to each magnetic layer 12, 14, thickening layer 19 may comprise more than one layer, in which the outer-most facing layers of the thickening layer 19 are physically annexed to each magnetic layer 12, 14. Thickening layer 19 may be physically annexed to each magnetic layer 12, 14 by virtually any method known to one skilled in the art. Preferably, thickening layer 19 may be physically annexed to each magnetic layer 12, 14 by an adhesive.

Referring to FIG. 3A, in a preferred embodiment of the present Invention, the outline of the magnetic layers 12, 14 and the outline of the thickening layer of the magnetic piece are of substantially equal size and shape to each other, and the shapes of each magnetic layer 12, 14 and the thickening layer are aligned with each other.

The magnetic sides of the present Invention are comprised of any suitable magnetic material which preferably has been magnetized to a sufficient level to prevent a magnetic piece from sliding off a substance it is magnetically attached to. More preferably, the magnetic sides are comprised of any suitable magnetic material which has been magnetized to a sufficient level to allow a magnetic piece to be magnetically attached to substance so that the magnetic attraction between the magnetic piece and the substance is sufficient to support the weight of the magnetic piece. One of ordinary skill in the art can select an appropriate material for magnetic layers 12, 14 from a number of such magnetic materials known in the art. It is believed that one such material is strontium ferride powder mixture with polymer boding.

Figure 3B:
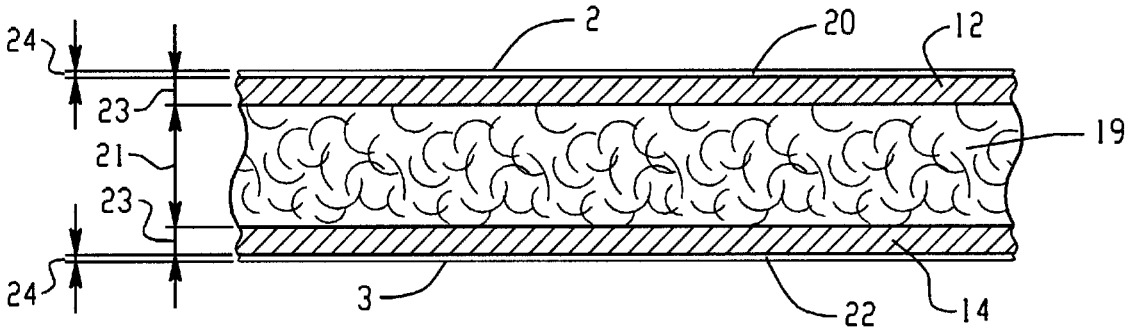
FIG. 3B is a partial view of a cross-section of a preferred embodiment of the present Invention taken along line 3B—3B in FIG. 3A.

In embodiments of this Invention illustrated in FIGS. 2, 3A and 3B, first and second magnetic sides 2 and 3 are magnetically attracted to any object susceptible to magnetic attraction, such as another magnetic piece of this Invention (aligned properly with properly spaced magnetic striping, as discussed below), or any ferromagnetic material. In use, a magnetic piece 1 of this Invention (aligned properly with properly spaced magnetic striping, as discussed below) is magnetically attracted to another magnetic piece 1 of this Invention, and will magnetically "stick" to another such magnetic piece. Magnetic pieces 1 of this Invention are thus stackable, in that any magnetic side of any magnetic piece I of this Invention will magnetically "stick" to a magnetic side of any other magnetic piece 1 of this Invention (aligned properly with properly spaced magnetic striping, as discussed below). Furthermore, a magnetic piece 1 of this Invention will magnetically "stick" to any ferromagnetic material, such as a refrigerator, the face of many appliances, or either a story board or story tin of this Invention as described further herein. Multiple magnetic pieces 1 of this Invention will thus magnetically "stick" to each other and allow stacking of additional magnetic pieces 1 of this Invention.

Figure 4:
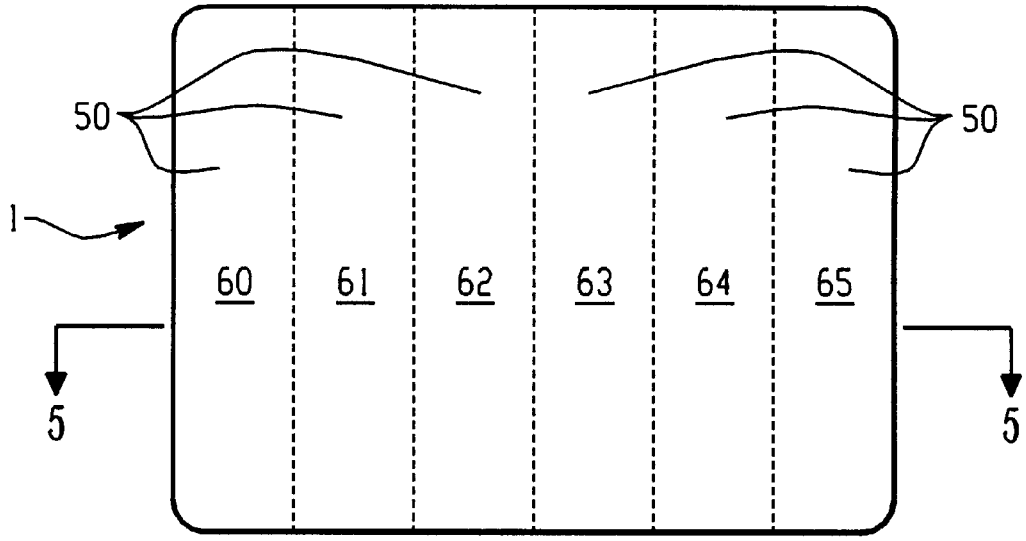
FIG. 4 is a top planar view of magnetic striping bands within a magnetic face of a magnetic piece of the present Invention.

Referring to FIG. 4, the magnetization of each magnetic side is created through the presence of magnetic striping in each side. Magnetic striping is achieved by creating at least two areas on each side, each of which has a magnetic domain pointing in a different direction. Areas which do not contain magnetic striping may be magnetically neutral, or produce no net magnetic field. Preferably, each side is divided into multiple bands, each of which has a magnetic domain pointing in a certain direction differing from the direction of an adjacent band. More preferably, each magnetic side is divided into multiple bands of uniform width, each band having a magnetic domain which alternates its polarity by 180° as compared to each adjacent band. Magnetic striping on both sides of each piece allows either side of any piece to magnetically "stick" to either side of any other piece.

In the embodiment of FIG. 4, a magnetic side of magnetic piece I is divided into multiple magnetic striping bands 50 illustrated as six bands. Each individual striping band is identified as band 60, 61, 62, 63, 64 and 65. While as illustrated the bands are of uniform width and are in a 40 generally up/down direction, the width of each band may be varied individually or collectively, making the bands thinner or thicker. Each individual band may be varied so that the width is not uniform along the length of the band. The bands may also run in a different direction, such as horizontally, or diagonally. Additionally, the number of bands may vary from at least 2 bands to the minimum number of bands required for a magnetic piece 1 of any given size in which each band 50 is a minimal width of 0.09 inch. In an embodiment of the present Invention, the width of each band is 0.09375 inch. Each magnetic striping band 50 can create a magnetic force attraction or repulsion with any object susceptible to magnetic attraction, including any ferromagnetic material which itself does not exhibit a net magnetic field. Such ferromagnetic material will be attracted to all striping in a magnetic side, regardless of the direction of each individual stripe. This magnetic force attraction thus allows a magnetic piece 1 of the present Invention to magnetically "stick" to a ferromagnetic material exhibiting no net magnetic field, including but not limited to, a refrigerator, many household appliances, or either a story board of story tin of this Invention as described further herein.

Figure 5:
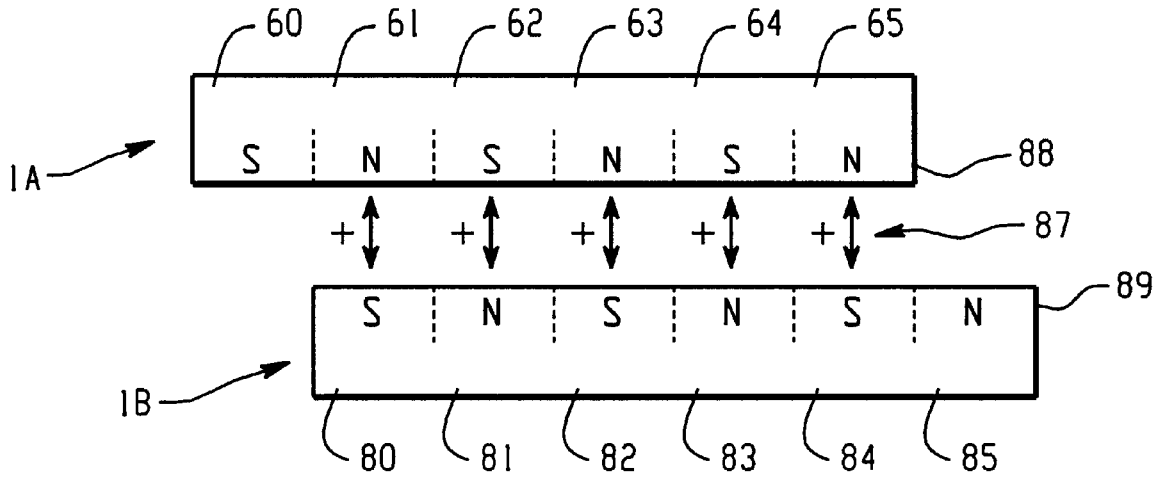
FIG. 5 is a cross-section of two magnetic pieces of FIG. 4 of the present Invention experiencing a magnetic force attraction, each cross-section taken alone line 5—5 in FIG. 4.

A magnetic piece 1 of the present Invention is also capable of magnetically "sticking" to another magnetic piece 1 of the present Invention if aligned properly with properly spaced magnetic striping. Referring to FIG. 5, two magnetic pieces 1A and 1B of the present Invention are magnetically attracted to each other. Magnetic side 88 of the first magnetic piece 1A is comprised of magnetic striping bands 60, 61, 62, 63, 64 and 65 exhibiting magnetic domains of alternating direction (indicated by S for the magnetic south pole and N for the magnetic north pole). Magnetic side 89 of the second magnetic piece 1B is comprised of magnetic striping bands 80, 81, 82, 83, 84 and 85 also exhibiting magnetic domains of altering direction. When the magnetic sides of the first magnetic piece 1A and the second magnetic piece 1B are located in close proximity to each other with the magnetic striping bands of each properly aligned, a magnetic force attraction 87 will exist between the two magnetic pieces which varies in strength by the distance between the two pieces. Specifically, the first and the second magnetic pieces 1 are aligned respective to each other so that the magnetic striping bands of each are running in the same direction. The first and second magnetic pieces 1 are further aligned respective to each other so that the north magnetic poles of the magnetic striping bands 50 of the magnetic side of the first magnetic piece 1 are directly opposite the south magnetic poles 69 of the magnetic striping bands 50 of the magnetic side of the second magnetic piece 1. As illustrated in FIG. 5, the north magnetic pole of striping band 61, 63 and 65 is aligned opposite the south magnetic pole of striping band 80, 82, and 84 respectively, and the south magnetic pole of striping band 62 and 64 is aligned opposite of the north magnetic pole of striping band 81 and 83, respectively. The north magnetic pole of a magnet will experience a magnetic force attraction with the south magnetic pole of another magnet due to the magnetic fields exhibited by both magnetic poles. Magnetic striping bands 61, 62, 63, 64 and 65 of the first magnetic piece 1 thus experience magnetic forces of attraction 87 with magnetic striping bands 80, 81, 82, 83 and 84 of the second magnetic piece 1. The result of these individual magnetic forces of attraction between each magnetic striping band is a net magnetic force of attraction between the magnetic sides of the first and the second magnetic piece 1, and thus a net magnetic force of attraction between the first and the second magnetic piece 1.

In use, magnetic striping of the magnetic sides of a magnetic piece 1 of the present Invention allows such magnetic pieces to magnetically "stick" to each other, and to further allow the stacking of multiple magnetic pieces 1 of the present Invention together. If two magnetic pieces 1 of the present invention are brought into close proximity of each other but initially aligned so that they experience a net magnetic force repulsion between each other, one or both of the magnetic pieces 1 will shift the distance of one magnetic striping band to one side or the other so that the magnetic pieces experience a net magnetic force attraction and thus magnetically "stick" together.

Figure 6:
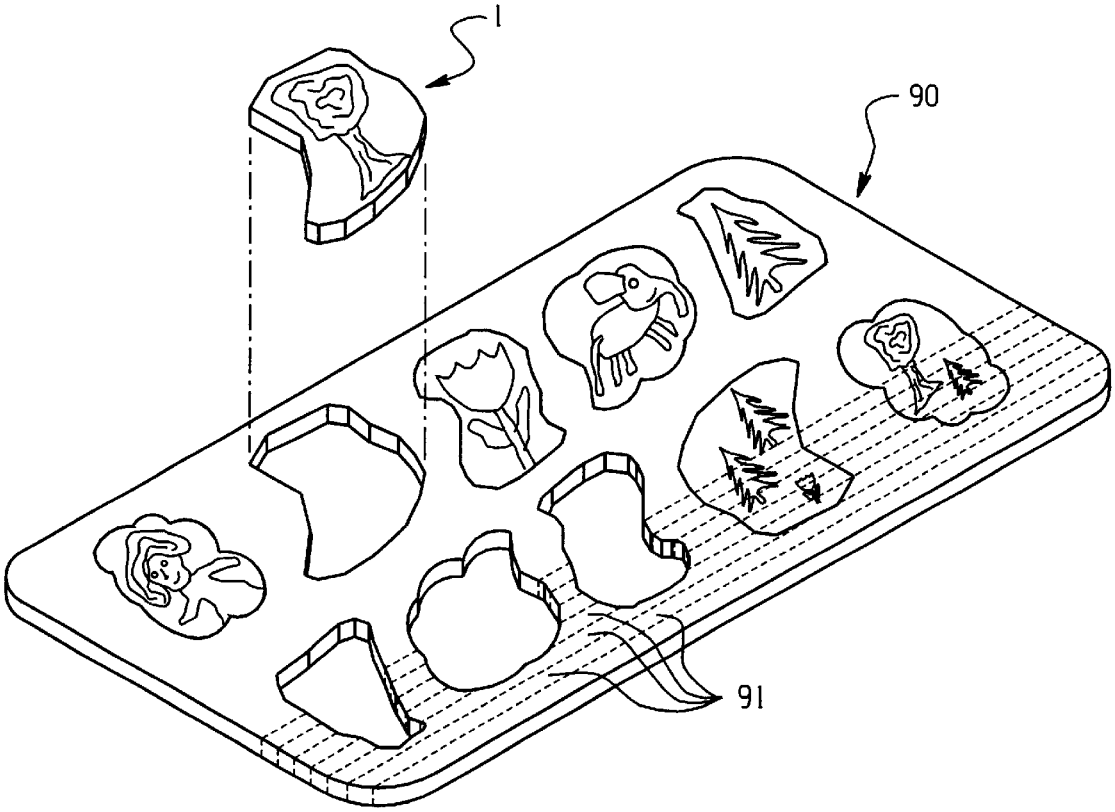
FIG. 6 is an angled, side view of an assembly from which magnetic pieces are die cut.

Referring to FIG. 6, magnetic pieces of the present Invention are manufactured by creating a sheet of material 90 from which each magnetic piece 1 is die cut. The sheet of material 90 comprises at least one layer of magnetic material upon which images have been annexed. Preferably, the sheet of material comprises an inner thickening layer, two magnetic layers sandwiching the thickening layer, and a layer of printing material on the exterior side of each thickening layer. The magnetic layers on each side of the sheet of material are magnetized, preferably with magnetic striping (partially illustrated at 91) of uniform width and direction with alternating magnetic domain directions. Images are annexed to the magnetic layers via the printing medium. The images are aligned so that the direction of the magnetic striping is consistent with the desired alignability of the magnetic piece which will have thereon the image. Each magnetic piece is die cut from the sheet of material so that the images affixed to the magnetic layers are consistent with the shape, size, position, and alignment of the die cut.

Each die cut is performed so that each side of the magnetic piece is parallel to the other side and normal to the surface of the piece exposed by the die cut. The printing medium is of a sufficient thickness and composition so as to allow a clean die cut forming a normal comer with each side. Preferably, the thickness and composition of the printing medium is 24 lbs. coated stock.

Preferably, a plurality of magnetic pieces are retained in the sheet of material 90 from which they were cut. Sheet of material 90 may be used for shipment of magnetic pieces, storage of magnetic pieces, or as a puzzle. The purchaser of a sheet of material 90 retaining magnetic pieces of the present Invention preferably removes the magnetic pieces from the retaining sheet of material 90 in order to facilitate use, including play by children, of the magnetic pieces. After removal of the magnetic pieces, sheet of material 90 may be retained to function as a puzzle and/or a storage medium. The voids in sheet of material 90 created by removing the magnetic pieces retain the shapes of the magnetic pieces so removed. A user of the magnetic pieces and the sheet of material, such as a child or anyone using the sheet for storage, may replace the removed magnetic pieces into the voids in the sheet of material. Thus, the magnetic pieces and the voids in the sheet of material form a puzzle wherein a user may place a magnetic piece in an appropriately sized and shaped void.

Figure 7:
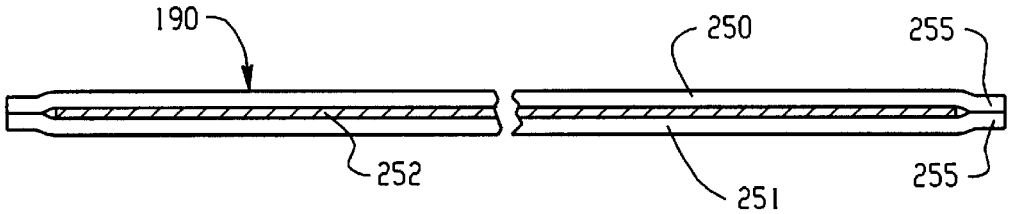
FIG. 7 is a cross-sectional view of a story board.
Figure 8:
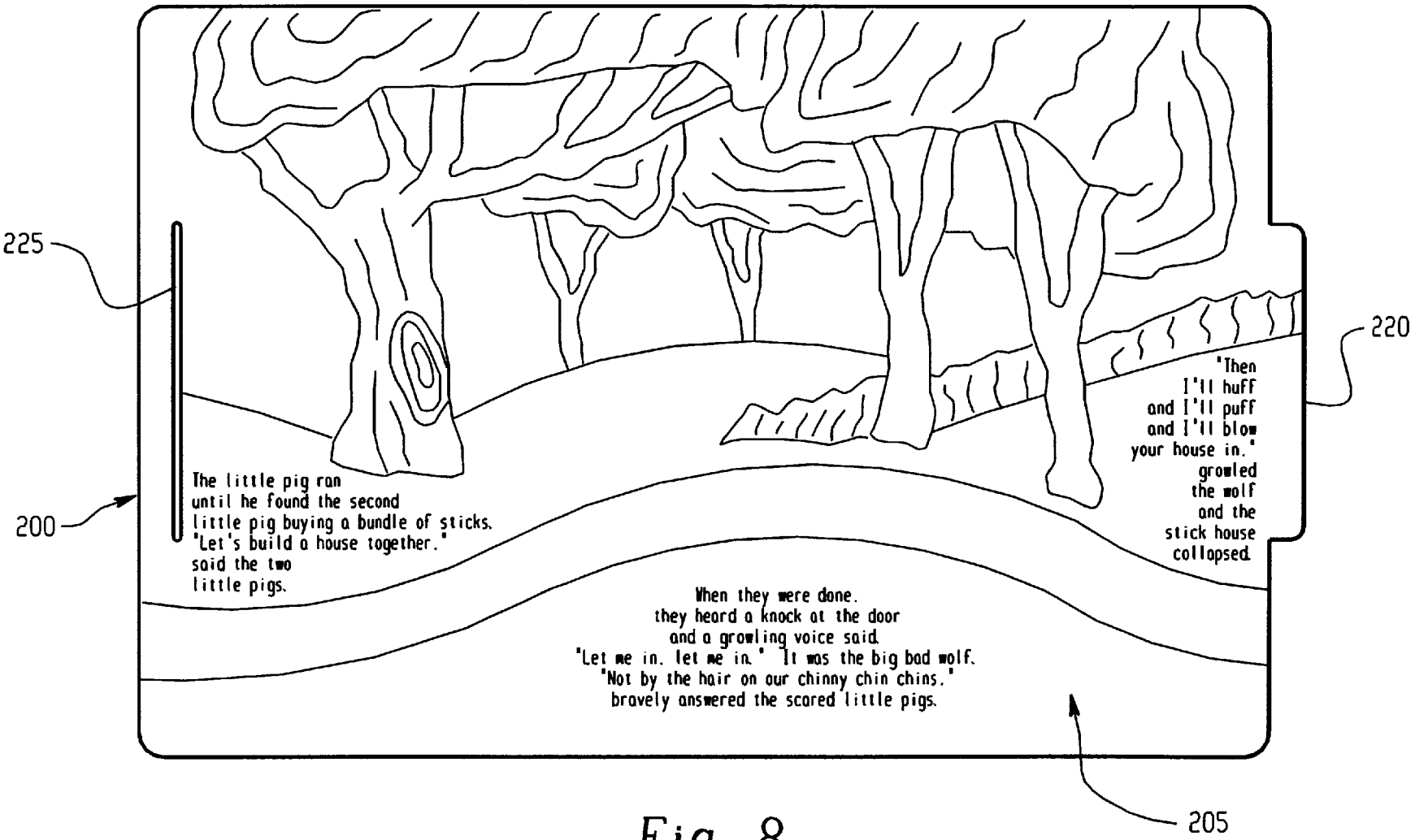
FIG. 8 is a planar view of a story board.
Figure 9:
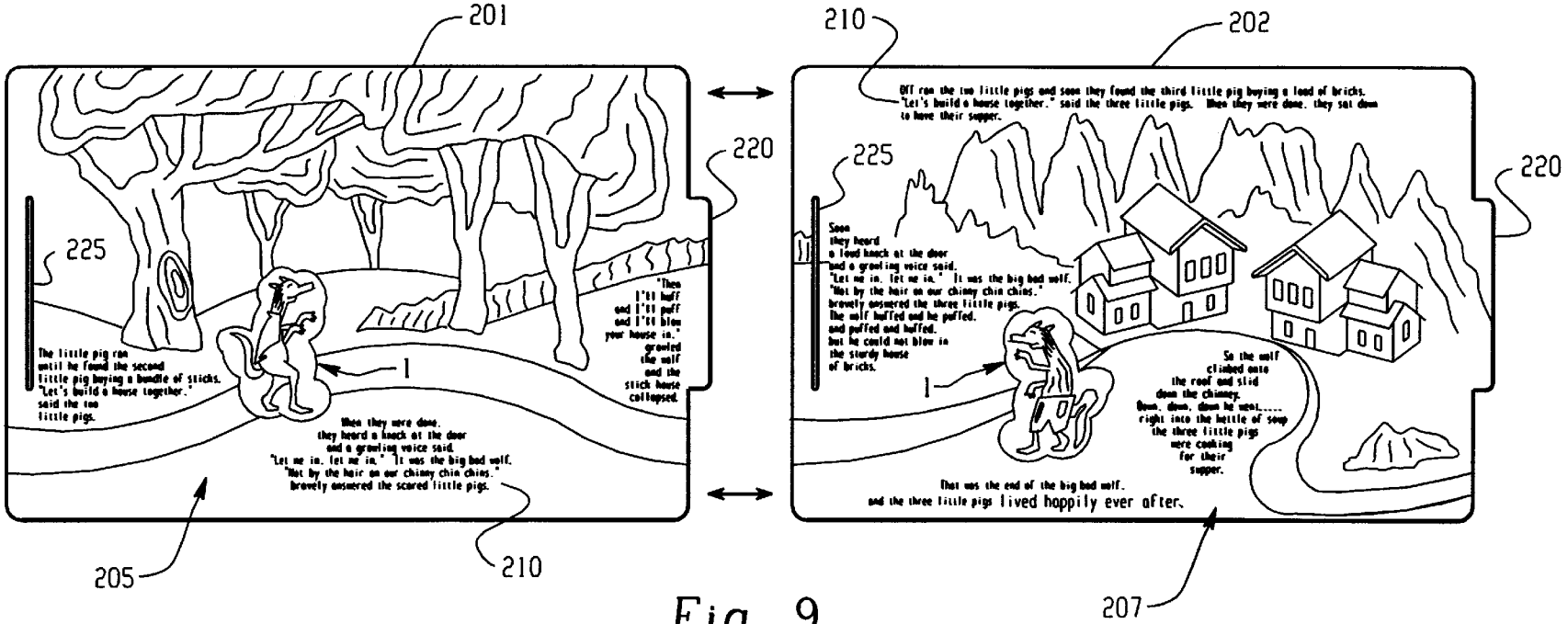
FIG. 9 is a planar view of two story boards in sequence.

Referring now to FIGS. 7–9, the present Invention further comprises at least one display board susceptible to attraction from a force created by a magnetic field. Referring specifically to FIG. 7, the display board 190 is comprised of a ferromagnetic material layer 252 contained within first and second layers of printing medium 250, 251. Ferromagnetic material layer 252 is magnetically attracted to first magnetic side 2 or a second magnetic side 3 of a magnetic piece 1. Display board 190 is constructed so that ferromagnetic layer 252 is completely contained within printing medium layers 250, 251. Printing medium layers 250, 251 are constructed to have a slightly larger surface area than ferromagnetic layer 252, so that edges 255 of the printing medium layer overlap the ferromagnetic layer. Edges 255 are annexed together to contain ferromagnetic layer 252 therein. The size of edges 255 is preferably minimized to the smallest size necessary to allow sufficient annexing together so that ferromagnetic layer 252 extends as closely as possible to the outer edges of printing medium layers 250, 251. In use, a magnetic piece 1 or multiple magnetic pieces 1 may be placed upon a display board and magnetically "stick" thereto. Furthermore, multiple magnetic pieces 1 may be "stacked" upon each other on the display board.

Referring to FIG. 8, in one embodiment, a display board of the present Invention is a story board 200. Story board 200 comprises an image of at least one scene 205 of a story on at least one side of story board 200. The image may contain settings, scenery, props, furniture, locations or other images indicative of or germane to a story. Preferably, referring to FIG. 9, story board 200 further comprises text 210 relating to the at least one scene 205. More preferably, story board 200 comprises two sides. Preferably, one side of story board 200 comprises at least one scene without any text, while the other side comprises the same scene with text 210 relating to the scene.

In use, a magnetic piece 1 having an image of a character, animal or object magnetically "sticks" to story board 200.

The character, animal or object of magnetic piece 1 is a character, animal or object within a story, a scene of which is illustrated on the story board. Preferably, the magnetic sides of magnetic piece 1 are biased to co-ordinate the characteristics of the character, animal or object to accommodate such character's, animal's or object's characteristics as are told in the specific scene of the story. More preferably, a child may place any magnetic piece I upon story board 200 to either follow the story of the scene or make up a new story for the scene. While this embodiment has been described with reference to the use of one magnetic piece 1 with story board 200, more than one magnetic piece 1 may be employed with a story board.

Referring to FIGS. 8 and 9, in a preferred embodiment, a story board 200 of the present Invention further comprises a tab 220 on one side and a receiving slot for a tab 225 on the other side. The tab 220 and receiving slot 225 are sized to allow tab 220 to fit into slot 225. Preferably, receiving slot 225 is sized slightly larger than tab 220 to allow some frictional engagement between a tab 220 and a receiving slot 225 when the tab is in the slot, while allowing easy engagement and disengagement of the slot into and from the receiving slot.

Referring to FIG. 9, in an additional embodiment, two story boards of the present Invention, first story board 201 and second story board 202, contain thereon a first scene of a story 205 and a second scene from the same story 207. Preferably, first and second scenes 205 and 207 comprise a sequence of scenes from a single story. Tab 220 of first story board 201 fits within receiving slot 225 of second story board 202, connecting second story board 202 to first story board 201 to evince a sequence of scenes from first scene 205 to second scene 207. While the present embodiment has been described with reference to two story boards, more than two story boards may be connected together in sequence for more than two scenes of a story. While the present embodiment has been described with reference to a tab and receiving slot as a method to connect two story boards, other methods of connection may be easily employed, such as using more than one tab with more than one receiving slot, using a differing number of tabs and receiving slots to force a particular sequence of story boards, using connecting devices which snap together, fasten together via hook and loop fasteners (e.g., Velcro fasteners), or zip together, or with a slot-and-groove construction.

In use, multiple story boards containing different scenes from a story are connected in sequence or randomly. A child follows the sequence of the scenes of the story boards, and may magnetically "stick" magnetic pieces 1 throughout the sequence of story boards. The child may furthermore move magnetic pieces 1 throughout the sequence of story boards to follow the story or create a story of the child's own, repeatedly "sticking" and "unsticking" magnetic pieces 1 to and from the story boards.

Figure 10A:
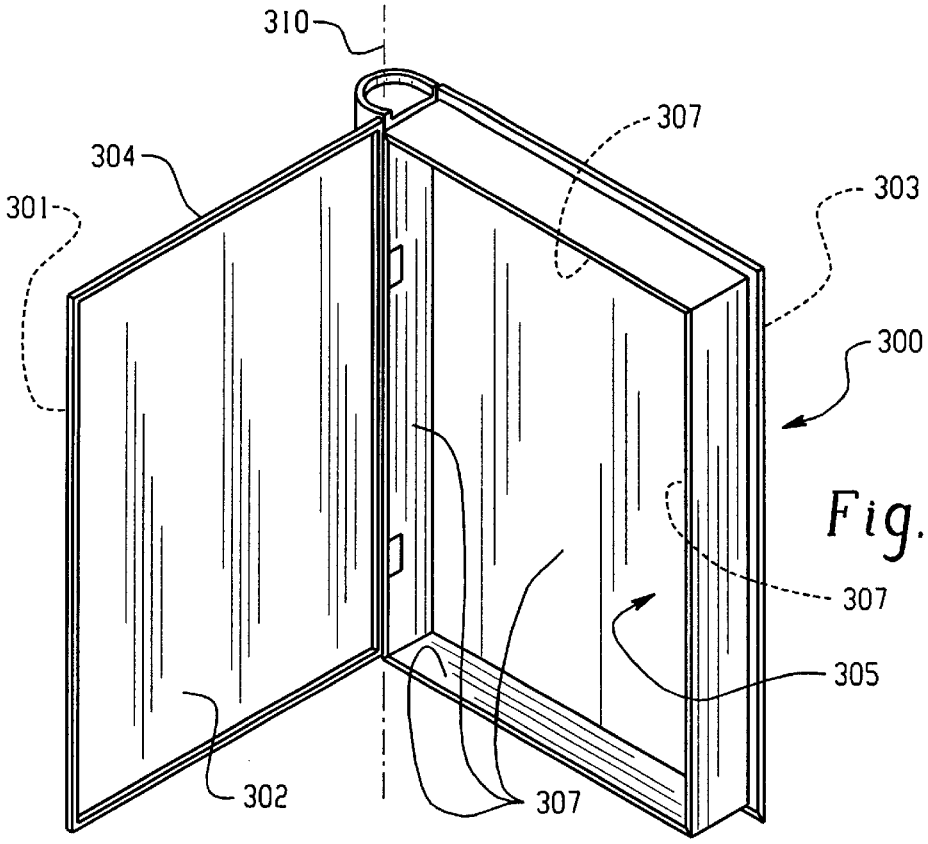
FIG. 10A is an angled, three-dimensional representation of a story tin in an open position.
Figure 10B:
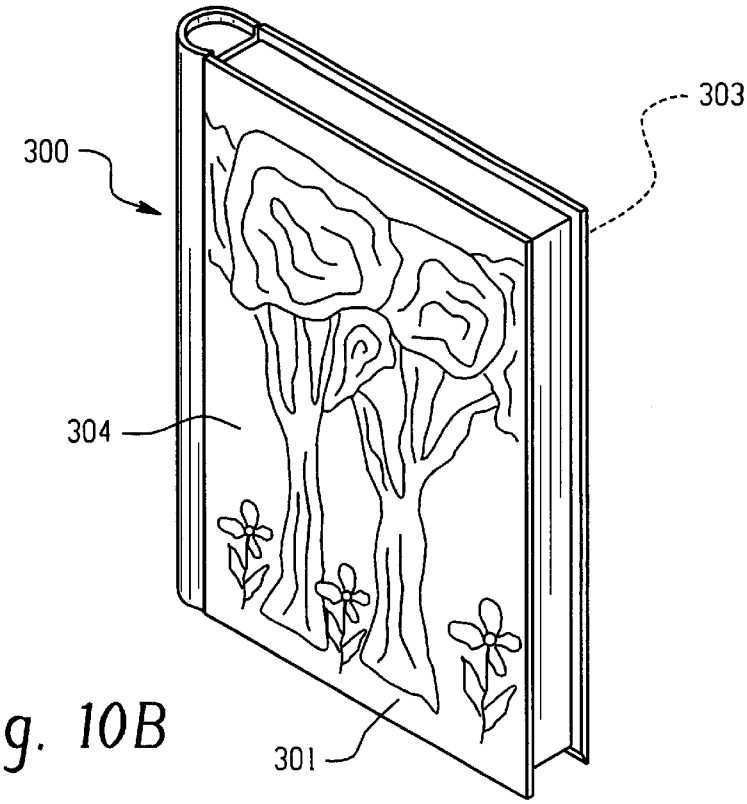
FIG. 10B is an angled, three-dimensional representation of the story tin of FIG. 10A in a closed position.

Referring to FIGS. 10A and 10B, in an alternative embodiment, the present Invention further comprises a story tin 300. Story tin 300 is comprised of a hinged cover 304 having a front 301 and a back 302, a containing space 305 defined by interior walls 307, and a back 303. Hinged cover 304 and back 303 are preferably comprised of a material susceptible to attraction from a force created by a magnetic field. More preferably, hinged cover 304 and back 303 are comprised of a material which exhibits and experiences a net magnetic force attraction with a magnetic piece 1. Still more preferably, hinged cover 304 and back 303 are comprised of a ferromagnetic material. Preferably, front 301 and back 302 of hinged cover 304 and back 303 each preferably comprise a graphical representation of at least one scene of a story. The graphical representation of at least one scene may contain settings, scenery, props, furniture, locations or other images indicative of or germane to a story. Preferably, the graphical representation of at least one scene further comprises text relating to the at least one scene.

Interior walls 307 define a containing space 305. The back 302 of hinged cover 304 comprises an interior wall which further defines containing space 305 when hinged cover 304 is in a closed position as illustrated in FIG. 10B. Hinged cover 304 pivots on an axis defined by the hinge 310 to an open position illustrated in FIG. 10A to provide access to the containing space 305. Containing space 305 is preferably large enough to contain at least one magnetic piece 1. More preferably, containing space 305 is large enough to contain multiple magnetic pieces 1.

Interior walls 307 are comprised of any solid material suitable for containing at least one magnetic piece 1. Preferably, interior walls 307 are comprised of a material susceptible to attraction from a force created by a magnetic field.

Referring to FIGS. 1A and 1B, story tin 300 is comprised of a hinged cover 304 having a raised area 320 on cover back 302. Raised area 320 frictionally fits into side wall receptor 325 when the cover is in the closed position. Side wall receptor 35 is comprised of interior walls 307 which engage the raised area 320 when the cover is in the closed position.

Figure 11A:
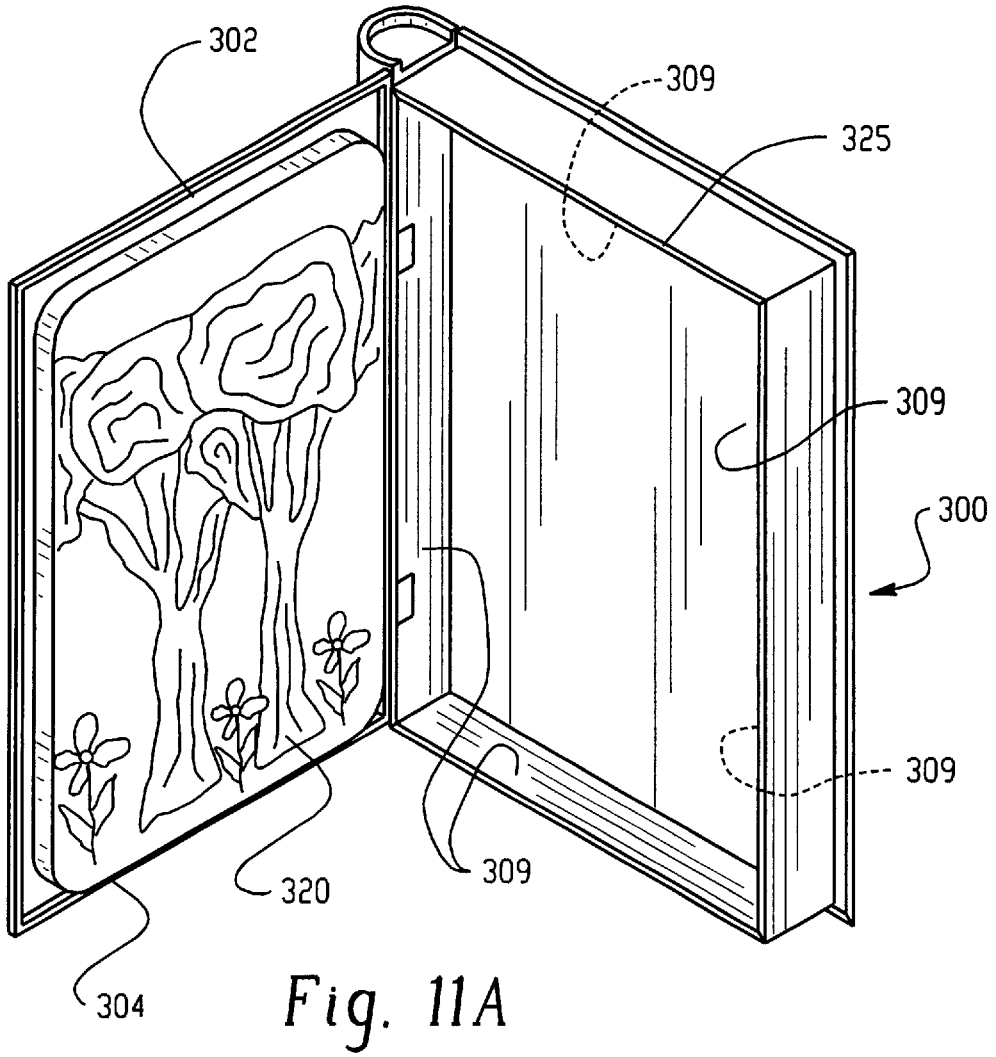
FIG. 11A is an angled, three-dimensional representation of an embodiment of a story tin in an open position.
Figure 11B:
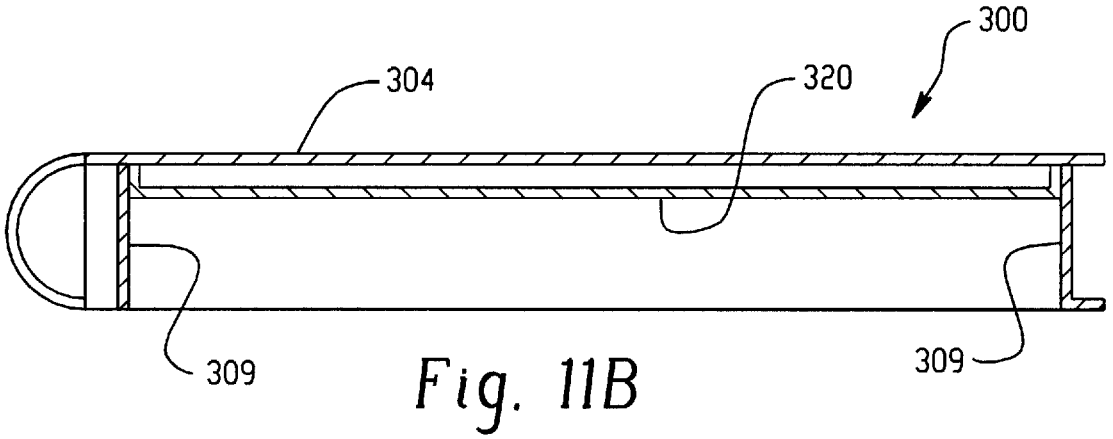
FIG. 11B is a cross-sectional view of the embodiment of the story tin of FIG. 11A in a closed position.

In use, story tin 300 provides storage for a plurality of magnetic pieces 1 within containing space 305. With cover 304 in a closed position as illustrated in FIG. 11B, magnetic pieces 1 are entirely contained within the story tin and capable of easy transportation or storage. Furthermore, story tin provides a location for magnetically "sticking" magnetic pieces 1. Preferably, the scenes contained upon story tin 300 comprise a story or part of a story with which magnetic pieces 1 contained within the story tin may be a part. More preferably, the magnetic pieces I contained within story tin 300 comprise characters, animals or objects which are integral parts of the scenes of the story depicted upon the story tin 300, allowing a child playing with a magnetic piece of the present invention to repeatedly affix and remove magnetic pieces 1 to and from story tin 300 in accordance with a story.

While the story tin 300 of this preferred embodiment has been described as having one containing space, and one hinged cover, and has been illustrated as being generally square in shape, a story tin of this Invention may comprise more than one containing space, more than one hinged cover, and may be of a shape different from generally square. Preferably, a story tin 300 of this preferred embodiment has an over-all shape and appearance of a hard-cover bound book.

In an alternative embodiment of the present Invention, the objects in the images comprise parts or portions of a larger object. For example, in this alternate embodiment, the object(s) in the images on both sides comprise any combination or permutation of any one or more parts of the following larger things: part(s) of a robot, or part(s) of an insect or arthropod, or part(s) of a flower or other plant, or part(s) of a character (as defined above), or part(s) of an animal, or part(s) of a dwelling or other building, etc. There may be, for example, one or more body magnetic pieces, one or more member magnetic pieces, and one or more accessory magnetic pieces. An object imaged on a body magnetic piece is a main body component (e.g., trunk, torso, thorax, abdomen, and/or abdomen and thorax) of the larger thing (with or without one or more of the member components and/or accessory components), an object imaged on a member magnetic piece is at least one member component (e.g., head, arm, leg, wing, appendage, hair, facial hair) of the larger thing, an object imaged on an accessory magnetic piece is at least one accessory component (e.g., hat, ball, glove, musical instrument, shoe, boot, mask, crown, scepter, tool, jet pack, weapon, armor, shield, etc.). A magnetic piece may have any number of any combination or permutation of any of the foregoing, e.g., any one of the member components with any one or more of any of the accessory components, such as an arm with a tool or weapon. All of these pieces can be made as discussed above in connection with the other embodiments hereof. See FIGS. 3A, 3B, 4, 5, and 6, and the accompanying text. Preferably, each main body magnetic piece has annexed on each exterior side thereof a different image of a main body component, each accessory magnetic piece has annexed on each exterior side thereof a different image of an accessory component, and each member magnetic pieces has annexed on each exterior side thereof a different image of a member component.

Characteristics of main body components of a human torso include, but are not limited to, any combination or permutation of any of the following: facial expression, hair color, skin color, eye color, torso position, expression of mood, clothing, clothing accessories, and general accessories. Characteristics of main body components of an animal torso include, but are not limited to, any combination or permutation of any of the following: facial expression, hair color, skin color, eye color, torso position and accessories. Characteristics of main body components of an insect torso include, but are not limited to, any combination or permutation of any of the following: antennae, eyes, size and shape of head, abdomen or thorax, hair, physical condition.

Characteristics of member components include, but are not limited to, any combination or permutation of any of the following: length, width, color, accessories, clothing, position, number of digits and transparency.

In use, member components and accessory components magnetically "stick" to main body components, and to each other, and may be "stacked" thereupon, allowing multiple member components to stick to a single main body component. Preferably, each side of all components magnetically stick to either side of any other component and all may be stacked. A child playing with a magnetic piece of this embodiment may stack any number or combination of member components and/or accessory components to any number or combination of main body components to create real or imaginary characters, animals, insects, flowers, etc.

Therefore, the invention in its broader aspects is not limited to the specific details, representative apparatus, and illustrative examples shown and described. Accordingly, departures may be made from such details without departing from the spirit or scope of the applicant's general inventive concept.

We claim:

1. A magnetic piece comprising first and second magnetic sides, said first magnetic side having disposed thereon a first image, and said second magnetic side having disposed thereon a second image, said first and second images facing outwardly, and wherein said first image comprises a first expression of an object and further wherein said second image comprises a second expression of the object, said second expression of the object having at least one characteristic of the object that is different than in the first expression.

2. A magnetic piece according to claim 1 wherein said first and second magnetic sides are oppositely disposed and positioned generally parallel to one another.

3. A magnetic piece according to claim 1 wherein the object is a character having the at least one characteristic, said first image comprises a first expression of the character, and said second image comprises a second expression of the character with the at least one characteristic of the character being different than the at least one characteristic in said first image.

4. A magnetic piece according to claim 1 wherein the object is a character, the at least one characteristic is a facial expression, said first image comprises a first expression of the character with a first facial expression, and said second image comprises a second expression of the character with a second facial expression that is different than the first facial expression.

5. A magnetic piece according to claim 1 wherein the object is a character, the at least one characteristic is body position, said first image comprises a first expression of the character in a first body position, and said second image comprises a second expression of the character in a second body position that is different than the first body position.

6. A magnetic piece according to claim 1 wherein the object is a clothed character, the at least one characteristic is clothing, said first image comprises a first expression of the clothed character, and said second image comprises a second expression of the clothed character wearing at least one article of clothing that is different than in said first expression.

7. A magnetic piece according to claim 1 wherein the object is an animal having at least one characteristic, said first image comprises a first expression of the animal, and said second image comprises a second expression of the animal with at least one characteristic of the animal being different than the at least one characteristic in said first expression.

8. A magnetic piece according to claim 1 wherein the object is an inanimate object having at least one characteristic, said first image comprises a first expression of the inanimate object, and said second image comprises a second expression of the inanimate object with at least one characteristic of the animal being different than the at least one characteristic in said first expression.

9. A magnetic piece according to claim 1 wherein the object is a building having at least one characteristic, said first image comprises a first expression of the building, and said second image comprises a second expression of the building with the at least one characteristic of the building being different than the at least one characteristic in said first expression.

10. A magnetic piece according to claim 1 wherein the object is a building, the at least one characteristic is building condition, said first image comprises a first expression of the building in a first condition, and said second image comprises a second expression of the building in a second condition that is different than the first condition.

11. A magnetic piece according to claim 1 wherein the at least one characteristic is lighting, said first image comprises a first expression of the object having a first lighting, and said second image comprises a second expression of the object having a second lighting.

12. A magnetic piece according to claim 1 wherein the at least one characteristic is time, said first image comprises a first expression of the object at a first time, and said second image comprises a second expression of the object at a second time.

13. A magnetic piece according to claim 12 wherein said first image comprises a first expression of the object during the day time, and said second image comprises a second expression of the object during the night time.

14. A magnetic piece according to claim 1 wherein the at least one characteristic is appearance caused by season, said first image comprises a first expression of the object at a first season, and said second image comprises a second expression of the object at a second season.

15. A magnetic piece according to claim 1 wherein said magnetic piece comprises a single layer of magnetic material having first and second sides, said first image being disposed on said first side of said single layer of magnetic material, and said second image being disposed on said second side of said single layer of magnetic material.

16. A magnetic piece according to claim 15 wherein said first image is disposed upon a first layer of printing medium physically annexed to said first side of said single layer of magnetic material, and said second image is disposed upon a second layer of printing medium physically annexed to said second side of said single layer of magnetic material.

17. A magnetic piece according to claim 1 wherein said magnetic piece further comprises a thickening layer, said thickening layer sandwiched between and physically annexed to first and second layers of magnetic material, said first image being disposed on a side of said first layer of magnetic material, and said second image being disposed on a side of said second layer of magnetic material.

18. A magnetic piece according to claim 17 wherein said first image is disposed upon a first layer of printing medium physically annexed to a side of said first layer of magnetic material, and said second image is disposed upon a second layer of printing medium physically annexed to a side said second layer of magnetic material.

19. A magnetic piece according to claim 1 wherein at least one magnetic piece is magnetically stackable upon another at least one magnetic piece.

20. A magnetic piece according to claim 1 wherein at least one magnetic piece is magnetically stackable upon another at least one magnetic piece, wherein an image on a magnetic side of a first at least one magnetic piece is aligned relative to an image on a magnetic side of a second at least one magnetic piece.

21. A magnetic piece according to claim 1 wherein said first and second magnetic sides are magnetized.

22. A magnetic piece according to claim 2 wherein said first and second magnetic sides are magnetized.

23. A magnetic piece according to claim 3 wherein said first and second magnetic sides are magnetized.

24. A magnetic piece according to claim 4 wherein said first and second magnetic sides are magnetized.

25. A magnetic piece according to claim 5 wherein said first and second magnetic sides are magnetized.

26. A magnetic piece according to claim 6 wherein said first and second magnetic sides are magnetized.

27. A magnetic piece according to claim 7 wherein said first and second magnetic sides are magnetized.

28. A magnetic piece according to claim 8 wherein said first and second magnetic sides are magnetized.

29. A magnetic piece according to claim 9 wherein said first and second magnetic sides are magnetized.

30. A magnetic piece according to claim 10 wherein said first and second magnetic sides are magnetized.

31. A magnetic piece according to claim 11 wherein said first and second magnetic sides are magnetized.

32. A magnetic piece according to claim 12 wherein said first and second magnetic sides are magnetized.

33. A magnetic piece according to claim 13 wherein said first and second magnetic sides are magnetized.

34. A magnetic piece according to claim 14 wherein said first and second magnetic sides are magnetized.

35. A magnetic piece according to claim 15 wherein said first and second magnetic sides are magnetized.

36. A magnetic piece according to claim 16 wherein said first and second magnetic sides are magnetized.

37. A magnetic piece according to claim 17 wherein said first and second magnetic sides magnetized.

38. A magnetic piece according to claim 18 wherein said first and second magnetic sides are magnetized.

39. A magnetic piece according to claim 19 wherein said first and second magnetic sides are magnetized.

40. A magnetic piece according to claim 20 wherein said first and second magnetic sides are magnetized.

* * * * *

UNITED STATES PATENT AND TRADEMARK OFFICE

CERTIFICATE OF CORRECTION

PATENT NO. : 6,484,428 B1 
DATED : November 26, 2002
INVENTOR(S) : Evelyn Greenwald, Patrick Baran and Paul Tamulewicz It is certified that error appears in the above-identified patent and that said Letters Patent is hereby corrected as shown below:

Column 1,
Lines 5-26, please delete

"COPYRIGHT NOTICE

All of the individual images and collections of images in this Appendix are Copyright, Creativity for Kids. Thus, this Appendix contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

IMAGE DESCRIPTION

The sheets that follow are double-sided color copies of actual double-sided magnetic pieces and story boards embodying the present invention. The magnetic pieces are copied in two forms, (i) with the sandwiched sheet of material from which they were cut and (ii) removed from that sheet. Although the two sides of each double-sided copy are not precisely aligned, it is believed that one of ordinary skill in the art can understand which two images in this Appendix appear on each side of each double-sided piece, based on image size, image location, image content, image orientation, etc."

Column 10,
Line 23, please delete "1A and 1B" and insert -- 11A and 11B --.

Signed and Sealed this

Twenty-ninth Day of April, 2003

JAMES E. ROGAN
*Director of the United States Patent and Trademark Office*